US007628250B2

(12) United States Patent
Abram et al.

(10) Patent No.: US 7,628,250 B2
(45) Date of Patent: Dec. 8, 2009

(54) PASSIVE VALVE ASSEMBLY FOR VEHICLE EXHAUST SYSTEM

(75) Inventors: Kwin Abram, Columbus, IN (US); Ivan Arbuckle, Columbus, IN (US); Joseph Callahan, Greenwood, IN (US)

(73) Assignee: Emcon Technologies LLC, Wilmington, DE (US)

( * ) Notice: Subject to any disclaimer, the term of this patent is extended or adjusted under 35 U.S.C. 154(b) by 41 days.

(21) Appl. No.: 11/953,930

(22) Filed: Dec. 11, 2007

(65) Prior Publication Data

US 2009/0127023 A1 May 21, 2009

Related U.S. Application Data

(60) Provisional application No. 60/989,508, filed on Nov. 21, 2007.

(51) Int. Cl.
*F01N 1/02* (2006.01)
*F01N 7/02* (2006.01)
*F01N 7/08* (2006.01)

(52) U.S. Cl. ..... 181/254; 181/232; 181/227; 181/228; 60/324

(58) Field of Classification Search ..... 181/254, 181/232, 249, 255, 271, 277, 278, 237, 227, 181/228, 250; 60/324, 322
See application file for complete search history.

(56) References Cited

U.S. PATENT DOCUMENTS 1,459,797 A * 6/1923 Parolini et al. ..... 181/232
3,780,826 A * 12/1973 Hubbell, III ..... 181/227
3,807,527 A * 4/1974 Bergson et al. ..... 181/232
3,853,200 A * 12/1974 Bergson et al. ..... 181/232
4,645,031 A * 2/1987 Omura et al. ..... 181/232
4,699,244 A * 10/1987 Bergquist et al. ..... 181/226
4,880,078 A * 11/1989 Inoue et al. ..... 181/232
5,245,140 A * 9/1993 Wu ..... 181/232
5,493,080 A * 2/1996 Moss ..... 181/232
5,726,397 A * 3/1998 Mukai et al. ..... 181/232
5,739,483 A * 4/1998 Yashiro et al. ..... 181/254
5,984,045 A * 11/1999 Maeda et al. ..... 181/254
6,173,808 B1 * 1/2001 Maeda et al. ..... 181/254
6,454,047 B1 * 9/2002 Galaitsis ..... 181/254
6,938,729 B2 * 9/2005 Worner et al. ..... 181/254
7,021,420 B2 * 4/2006 Galaitsis ..... 181/232
7,090,048 B2 * 8/2006 Albertson et al. ..... 181/240
2002/0033302 A1 * 3/2002 Kaneko et al. ..... 181/232
2005/0155816 A1 * 7/2005 Alcini et al. ..... 181/237
2005/0189166 A1 * 9/2005 Kikuchi et al. ..... 181/237
2006/0260868 A1 * 11/2006 Suzuki et al. ..... 181/237

(Continued)

FOREIGN PATENT DOCUMENTS

JP 61138813 A * 6/1986

*Primary Examiner*—Edgardo San Martin
(74) *Attorney, Agent, or Firm*—Carlson Gaskey & Olds

(57) ABSTRACT

An exhaust component includes at least one muffler that has an inlet and an outlet. One pipe body is connected to each of the inlet and the outlet. The pipe bodies each have first and second ends that define a respective overall pipe length. Each pipe body defines a sole exhaust flow path between their first and second ends. A passive valve assembly is mounted outside of the muffler and within one of the pipe bodies. The passive valve assembly is positioned at a location within a first 25% of the overall pipe length of one of the pipe bodies relative to the inlet or outlet of the muffler.

21 Claims, 2 Drawing Sheets

U.S. PATENT DOCUMENTS

2007/0045043 A1* 3/2007 Hoerr et al. ..... 181/250
2008/0083218 A1* 4/2008 Abram et al. ..... 60/324
2008/0223025 A1* 9/2008 Hill ..... 60/324
2008/0236680 A1* 10/2008 Abram et al. ..... 137/527

* cited by examiner

PASSIVE VALVE ASSEMBLY FOR VEHICLE EXHAUST SYSTEM

RELATED APPLICATIONS

This application claims priority to provisional application No. 60/989,508 filed on Nov. 21, 2007.

TECHNICAL FIELD

The subject invention relates to a passive valve in a vehicle exhaust system, and more particularly relates to a location of a passive valve in relation to other exhaust system components.

BACKGROUND OF THE INVENTION

Exhaust systems are widely known and used with combustion engines. Typically, an exhaust system includes exhaust tubes that convey hot exhaust gases from the engine to other exhaust system components, such as mufflers, resonators, etc. A muffler includes acoustic chambers that cancel out sound waves carried by the exhaust gases. Although effective, mufflers are often relatively large in size and provide limited nose attenuation.

Passive valves have been used in a muffler to provide further noise attenuation. However, the proposed valves have numerous drawbacks that limit their widespread use in a variety of applications. One disadvantage with passive valves is their limited use in high temperature conditions. Another disadvantage with known passive valve configurations is that these valves do not effectively attenuate low frequency noise.

Attempts have been made to improve low frequency noise attenuation without using passive valves by either increasing muffler volume or increasing backpressure. Increasing muffler volume is disadvantageous from a cost, material, and packaging space perspective. Increasing backpressure can adversely affect engine power.

One solution is to locate the passive valve outside of the muffler. An example of such a configuration is found in applicant's co-pending application Ser. No. 11/950,034 filed on Dec. 4, 2007. While this solution has proven to be effective, other challenges are presented within the overall exhaust system by this type of mounting arrangement. A position of the passive valve in relation to other exhaust system components becomes an important characteristic from a noise reduction perspective. A specific position of the passive valve in the overall exhaust system is directly tied to the acoustic effectiveness of the valve. For example, positioning the valve at an acoustic velocity nodal point is ineffective.

Additional challenges are also presented by multi-exhaust component systems, such as systems that include more than one muffler for example. Positioning the passive valve in front of a main muffler can give rise to chatter issues due to a higher level of pressure pulsations.

Therefore, there is a need to provide an exhaust system and passive valve arrangement that can effectively attenuate low frequency noises without introducing other types of noise issues. This invention addresses those needs while avoiding the shortcomings and drawbacks of the prior art.

SUMMARY OF THE INVENTION

A vehicle exhaust system includes a passive valve that is positioned within the exhaust system at a certain positional relationship to other exhaust components to provide a significant acoustic advantage of noise attenuation for the exhaust system as a whole.

In one example, a vehicle exhaust system includes at least one muffler having an inlet and an outlet. A first pipe body is connected to the outlet and a second pipe body is connected to the inlet. A passive valve assembly is mounted within one of the first and second pipe bodies and is positioned at a location within a first 25% of an overall pipe length of a respective one of the pipe bodies relative to corresponding one of the inlet and outlet of the muffler.

In one example, the first pipe body has first and second ends. The first end is located at the muffler, and the pipe body extends to a second end to define the overall pipe length. The first pipe body defines a sole exhaust flow path between the first and the second ends. A passive valve assembly is mounted within the first pipe body and is positioned at a location within a first 25% of the overall pipe length relative to the first end, which is positioned at the outlet of the muffler.

In one example, the vehicle exhaust system includes at least first and second mufflers and an inter-pipe that connects the first muffler to the second muffler. The inter-pipe defines a sole exhaust gas flow path between the first and the second mufflers. The inter-pipe has a tube body with a first end connected to the first muffler and a second end connected to the second muffler. The tube body extends from the first end to the second end to define an overall inter-pipe length. The passive valve assembly is mounted within the tube body at a position between the first and the second ends. The passive valve assembly is positioned at a location within a first 25% of the overall pipe length relative to one of the first and the second ends.

In these examples, by positioning the passive valve assembly within the first 25% of the overall length as defined, the valve is close to the velocity anti-node position for acoustic resonances that exist within the associated pipes.

These and other features of the present invention can be best understood from the following specification and drawings, the following of which is a brief description.

DETAILED DESCRIPTION OF THE PREFERRED EMBODIMENT

Figure 1:
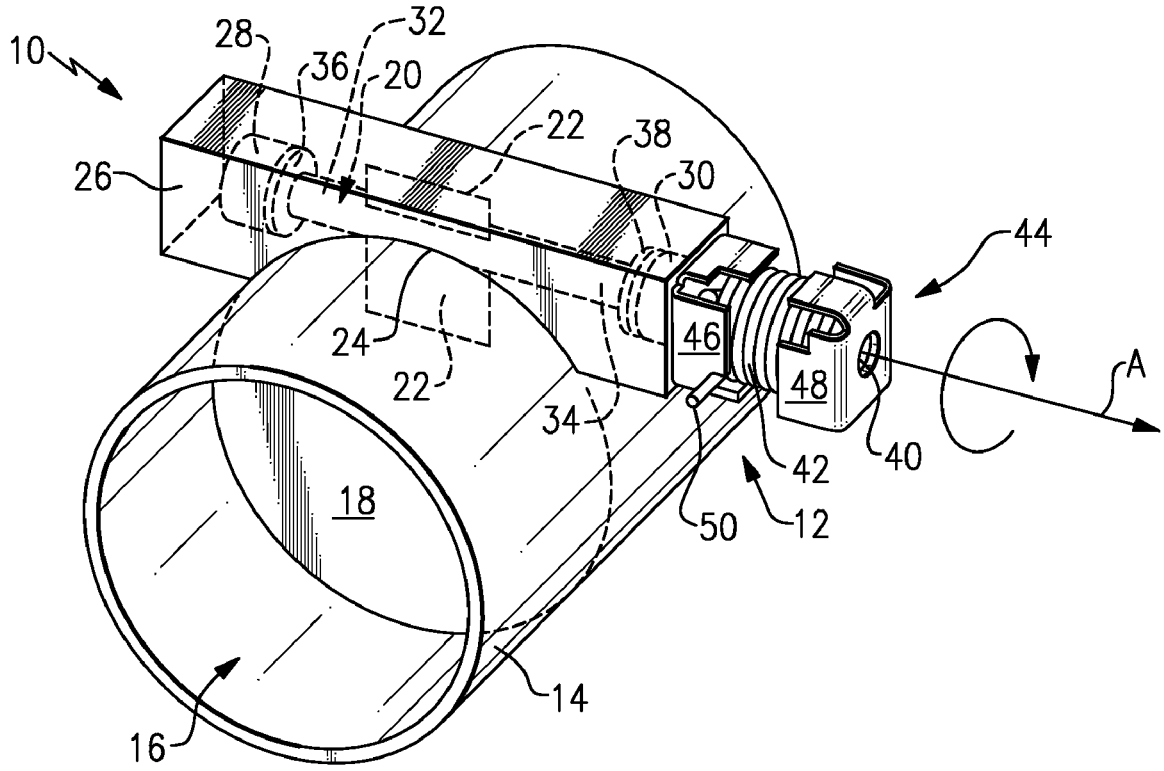
FIG. 1 shows a perspective view of an exhaust pipe component and passive assembly.

As shown in FIG. 1, an exhaust component, such as an exhaust tube or pipe 10 includes an exhaust throttling valve, referred to as a passive valve assembly 12. The passive valve assembly 12 is movable between an open position where there is minimal blockage of an exhaust gas flow path 16 and a closed position where a substantial portion of the exhaust gas flow path 16 is blocked. The passive valve assembly 12 is resiliently biased toward the closed position and is moved toward the open position when exhaust gas flow generates a pressure sufficient enough to overcome the biasing force.

In the example shown, the exhaust pipe 10 comprises a single tube body 14 that defines the exhaust gas flow path 16. The passive valve assembly 12 includes a valve body or vane 18 that blocks a portion of the exhaust gas flow path 16 when in the closed position. As discussed above, the vane 18 is pivoted toward the open position to minimize blockage of the exhaust gas flow path 16 in response to pressure exerted against the vane 18 by exhaust gases.

In one example, the vane 18 is fixed to a shaft 20 with a tang or bracket 22. A slot 24 is formed within an outer surface of the tube body 14. A housing 26, shown in this example as a square metal structure, is received within this slot 24 and is welded to the tube body 14. Other housing configurations could also be used. The shaft 20 is rotatably supported within the housing 26 by first 28 and second 30 bushings or bearings. In the example shown, the bracket 22 comprises a piece of sheet metal that has one portion welded to the shaft 20 and another portion that extends outwardly from the housing 26 and is welded to the vane 18. Thus, the vane 18 and the shaft 20 pivot together about an axis A that is defined by the shaft 20. The bracket 22 is just one example of how the shaft 20 can be attached to the vane 18, it should be understood that other attachment mechanisms could also be used.

The first bushing 28 is positioned generally at a first shaft end 32. The first bushing 28 comprises a sealed interface for the first shaft end 32. The shaft 20 includes a shaft body 34 that has a first collar 36 and a second collar 38. The first bushing 28 includes a first bore that receives the first shaft end 32 such that the first collar 36 abuts directly against an end face of the first bushing 28 to provide a sealed interface. As such, exhaust gases cannot leak out of the first bushing 28 along a path between the shaft 20 and first bushing 28.

The second bushing 30 includes a second bore through which the shaft body 34 extends to a second shaft end 40. The second collar 38 is located axially inboard of the second bushing 30. The shaft 20 extends through the second bore to an axially outboard position relative to the second bushing 30. A resilient member, such as a spring 42 for example, is coupled to the second shaft end 40 with a spring retainer 44. The spring retainer 44 includes a first retainer piece 46 that is fixed to the housing 26 and a second retainer piece 48 that is fixed to the second shaft end 40. One spring end 50 is associated with housing 26 via the first retainer piece 46 and a second spring end (not viewable in FIG. 1 due to the spring retainer 44) is associated with the shaft 20 via the second retainer piece 48.

Figure 2:
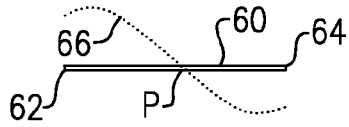
FIG. 2 shows an acoustic velocity mode shape for a pipe having open ends.

The passive valve assembly 12 is advantageously positioned within a vehicle exhaust system at a certain positional relationship to other exhaust components to provide a significant acoustic advantage for overall noise attenuation. FIG. 2 schematically shows a pipe 60 having open ends 62, 64. A typical acoustic velocity mode shape for this pipe configuration is shown at 66. It has been found that where the passive valve assembly 12 is positioned within an exhaust system determines its acoustic effectiveness. For example, positioning the passive valve assembly at an acoustic velocity nodal point P (FIG. 2) is ineffective for noise attenuation.

Figure 3:
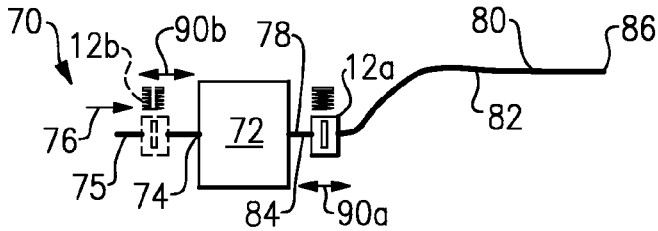
FIG. 3 shows one example of a passive valve in a vehicle exhaust system.

One example of a vehicle exhaust system 70 is shown in FIG. 3. This configuration includes at least one muffler 72 that has an inlet 74 that receives exhaust gas flow from an engine as indicated at 76. The muffler 72 can comprise the only muffler in the vehicle exhaust system 70 or, if other mufflers are included in the vehicle exhaust system 70, the muffler 72 comprises a rearmost muffler in the vehicle exhaust system 70. The muffler 72 includes an outlet 78 that directs exhaust gases to a tailpipe 80. The outlet 78 can comprise a tube 82 that is coupled to a rear of the muffler 72 and coupled to the tailpipe 80 or the tube 82 can comprise the tailpipe 80 itself.

In either configuration, the tube 82 forms the sole exhaust gas flow path between the muffler 72 and an outlet from the tailpipe 80, and the passive valve assembly 12 is the only valve located within this section of the exhaust system. In other words, there is no by-pass tube or path downstream of the muffler 72 for this configuration. As such, the tube 82 is defined as having a first end 84 that is coupled to the outlet 78 and a second end 86 that extends to the outlet from the tailpipe 80. The tube 82 has an overall length that extends from the first end 84 to the second end 86. This overall length is referred to as a developed length of the pipe or tube. The overall length does not have to be a straight-line length, i.e. the first 84 and second 86 ends can be non-coaxial, and the overall length can be defined as a length that is comprised of straight and curved portions added together.

In the example shown, a passive valve assembly 12*a* is mounted outside of, i.e. external to, the muffler 72 and within the tube 82 at a position between the first 84 and second 86 ends. To provide the most effective noise attenuation, the passive valve assembly 12*a* is positioned at a location within a first 25% of the overall pipe length relative to the first end 84 as indicated at 90*a*. By locating the passive valve assembly 12*a* in this location, the acoustic attenuation benefit of positioning the valve assembly 12*a* close to the velocity anti-node positions for the acoustic resonances existing within the tube 82 is provided.

In an alternate location, a passive valve assembly 12*b* is located within a tube or pipe 75 that is fluidly connected to the inlet 74 of the muffler 72. This pipe 75 defines an overall pipe length and comprises a sole exhaust flow path between the muffler 72 and an upstream exhaust component. The passive valve assembly 12*b* is positioned at a location within a first 25% of the overall pipe length relative to the inlet 74 as indicated at 90*b*.

Figure 4:
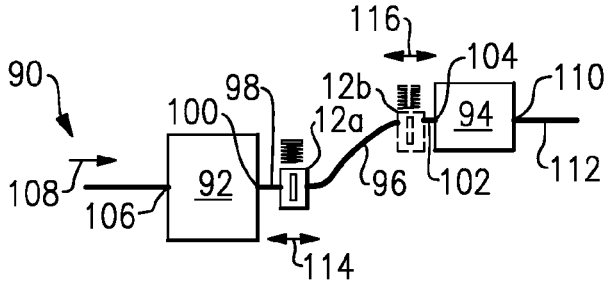
FIG. 4 shows another example of a passive valve in a vehicle exhaust system.

FIG. 4 shows another example of a vehicle exhaust system 90. In this configuration, there is a first muffler 92, a second muffler 94 and an inter-pipe 96 connecting the first 92 and second 94 mufflers. The inter-pipe 96 comprises the sole gas path between the first 92 and second 94 mufflers, i.e. a non-bypass configuration is provided, and the passive valve assembly 12 is the only valve located within this section of the exhaust system. The inter-pipe 96 includes a first end 98 that is coupled to an outlet 100 of the first muffler 92 and a second end 102 that is coupled to an inlet 104 of the second muffler 94. The inter-pipe 96 can be a single tube or can be comprised of multiple tube portions connected together to form a single tube between the first 92 and second 94 mufflers.

The first muffler 92 includes an inlet 106 that receives exhaust gas flow from an engine as indicated at 108. The second muffler 94 includes an outlet 110 that is coupled to a tailpipe 112. The passive valve assembly 12 is mounted within the inter-pipe 96 and is located at a position between the first 98 and second 102 ends at a location within a first 25% of the overall pipe length relative to one of first 98 and second 102 ends.

In one example, the passive valve assembly 12*a* is positioned within a first 25% of the overall pipe length relative to the first end 98 as indicated at 114. In another alternate example, the passive valve assembly 12*b* is positioned within a first 25% of the overall pipe length relative to the second end 102 as indicated at 116. In either example, by so locating the passive valve assembly 12*a* or 12*b*, the acoustic attenuation benefit of positioning the valve assembly 12*a* or 12*b* close to the velocity anti-node positions for the acoustic resonances existing within the inter-pipe 96 between the first 92 and second 94 mufflers is provided.

Figure 5:
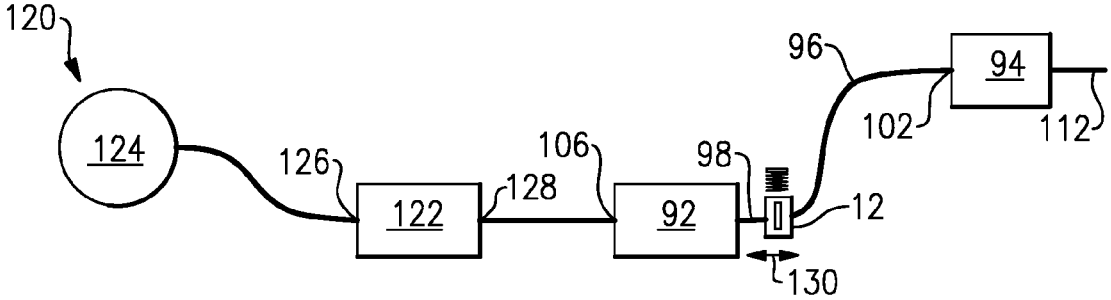
FIG. 5 shows another example of a passive valve in a vehicle exhaust system.

Another example of an exhaust system 120 is shown in FIG. 5. This example is similar to that of FIG. 4 but includes an additional foremost muffler 122 that is connected to an engine 124 upstream of the first muffler 92. The first 92 and second 94 mufflers in this configuration comprise additional or secondary mufflers that are used to provide additional noise attenuation. The foremost muffler 122 has an inlet 126 that is in fluid communication with the engine 124 and an outlet 128 that is in fluid communication with the inlet 106 of the first muffler 92. The passive valve assembly 12 is located in the inter-pipe 96 at a location within a first 25% of the overall pipe length relative to the first end 98 as indicated at 130.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A vehicle exhaust system comprising:

at least one muffler having an inlet and an outlet, said outlet comprising a first pipe body having a first end located at said at least one muffler and extending to a second end to define a first overall pipe length, said first pipe body defining a sole exhaust flow path between said first and said second ends of said first pipe body, and said inlet comprising a second pipe body having a first end located at said at least one muffler and extending to a second end to define a second overall pipe length, said second pipe body defining a sole exhaust flow path between said first and second ends of said second pipe body; and a passive valve assembly mounted outside of said at least one muffler and within one of said first and said second pipe bodies, said passive valve assembly being positioned at a location within a first 25% of a respective one of said first and said second overall pipe lengths relative to an associated one of said inlet and said outlet of said at least one muffler.

2. The vehicle exhaust system according to claim 1 wherein said at least one muffler comprises at least first and second mufflers with said first pipe body comprising an inter-pipe that connects an output from said first muffler to an inlet to said second muffler, said inter-pipe comprising the sole exhaust flow path between said first and said second mufflers, and wherein said passive valve assembly is mounted within said inter-pipe at a location within a first 25% of said first overall pipe length relative to said outlet of said first muffler.

3. The vehicle exhaust system according to claim 2 including a third muffler positioned upstream of said first muffler with said second muffler being positioned downstream of said first muffler, and including a tail pipe connected to an outlet from said second muffler.

4. The vehicle exhaust system according to claim 1 wherein said first pipe body comprises a tailpipe and wherein said passive valve assembly is mounted within said tailpipe at a location within a first 25% of said first overall pipe length relative to said outlet of said at least one muffler.

5. The vehicle exhaust system according to claim 1 wherein said passive valve assembly comprises a vane supported on a shaft for pivotable movement within said one of said first and said second pipe bodies between an open position and a closed position, and a spring that biases said vane toward said closed position, said vane being pivotal from said closed position towards said open position in response to an exhaust gas flow that exceeds a biasing force of said spring.

6. The vehicle exhaust system according to claim 1 wherein said first and said second ends of said one of said first and said second pipe bodies are non-coaxial.

7. The vehicle exhaust system according to claim 1 wherein said second pipe body comprises an input pipe that defines a sole flow path between said at least one muffler and an upstream exhaust component, and wherein said passive valve assembly is mounted within said input pipe at a location within a first 25% of said second overall pipe length relative to said inlet of said at least one muffler.

8. A vehicle exhaust system comprising:

a first muffler;

a second muffler connected to said first muffler by an inter-pipe that defines a sole exhaust gas flow path between said first and said second mufflers, said inter pipe having a tube body with a first end connected to said first muffler and a second end connected to said second muffler wherein said tube body extends from said first end to said second end to define an overall inter-pipe length; and a passive valve assembly mounted within said tube body at a position between said first and said second ends, said passive valve assembly being positioned at a location within a first 25% of said overall pipe length relative to one of said first and said second ends.

9. The vehicle exhaust system according to claim 8 wherein said passive valve assembly is positioned within a first 25% of said overall pipe length relative to said first end.

10. The vehicle exhaust system according to claim 8 wherein said passive valve assembly is positioned within 25% of said overall pipe length relative to said second end.

11. The vehicle exhaust system according to claim 8 including a third muffler positioned upstream of said first muffler and a tailpipe connected to an outlet from said second muffler, said first muffler being positioned upstream of said second muffler.

12. The vehicle exhaust system according to claim 8 wherein said passive valve assembly comprises the only valve assembly positioned between said first and said second mufflers.

13. The vehicle exhaust system according to claim 8 wherein said passive valve assembly comprises a vane supported on a shaft for pivotable movement within said tube body between an open position and a closed position, and a spring that biases said vane toward said closed position, said vane being pivotal from said closed position towards said open position in response to an exhaust gas flow that exceeds a biasing force of said spring.

14. The vehicle exhaust system according to claim 13 wherein said first muffler has an inlet that receives exhaust gas flow from an engine and wherein said second muffler has an outlet that directs exhaust gas flow to a tailpipe.

15. The vehicle exhaust system according to claim 14 and wherein said passive valve assembly comprises the only valve assembly positioned between said inlet and an outlet from said tailpipe.

16. The vehicle exhaust system according to claim 1 wherein said first and said second overall pipe lengths comprise developed pipe lengths, and wherein said first 25% of a respective one of said first and said second overall pipe lengths relative to an associated one of said inlet and said outlet of said at least one muffler generally corresponds to an anti-nodal position for acoustic resonances existing within said one of said first and said second pipe bodies.

17. The vehicle exhaust system according to claim 1 wherein said passive valve assembly is located only within one of said first and said second pipe bodies such that said other of said first and second pipe bodies is valveless.

18. The vehicle exhaust system according to claim 1 wherein said passive valve assembly is the only valve assembly located between said second end of said first pipe body and said second of said second pipe body.

19. The vehicle exhaust system according to claim 8 wherein said overall inter-pipe length comprises a developed pipe length, and wherein said passive valve assembly is the only valve assembly located within an exhaust flow path between an inlet to said first muffler and an outlet from said second muffler.

20. The vehicle exhaust system according to claim 19 wherein said inlet to said first muffler comprises a first pipe body having a first end located at said inlet and extending to a second end to define a first overall pipe length, said first pipe body defining a sole exhaust flow path between said first and said second ends of said first pipe body, and wherein said outlet from said second muffler comprises a second pipe body having a first end located at said outlet and extending to a second end to define a second overall pipe length, said second pipe body defining a sole exhaust flow path between said first and second ends of said second pipe body, and wherein said passive valve is the only valve located between said second end of said first pipe body and said second end of said second pipe body.

21. The vehicle exhaust system according to claim 19 wherein said first 25% of said overall pipe length relative to said one of said first and said second ends generally corresponds to an anti-nodal position for acoustic resonances existing within said inter-pipe.

* * * * *